US010923035B1

(12) United States Patent
Weng et al.

(10) Patent No.: US 10,923,035 B1
(45) Date of Patent: Feb. 16, 2021

(54) PIXEL CIRCUIT, DRIVING METHOD AND DISPLAY APPARATUS

(71) Applicants: Fuzhou BOE Optoelectronics Technology Co., Ltd., Fujian (CN); BOE Technology Group Co., Ltd., Beijing (CN)

(72) Inventors: Zuwei Weng, Beijing (CN); Yupeng Huang, Beijing (CN); Weize Xu, Beijing (CN)

(73) Assignees: Fuzhou BOE Optoelectronics Technology Co., Ltd., Fuzhou (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/939,091

(22) Filed: Jul. 27, 2020

(30) Foreign Application Priority Data

Nov. 21, 2019 (CN) ..... 201911147729.0

(51) Int. Cl.
*G09G 3/3258* (2016.01)

(52) U.S. Cl.
CPC ... *G09G 3/3258* (2013.01); *G09G 2320/0233* (2013.01)

(58) Field of Classification Search
CPC ..... G09G 3/3258; G09G 2320/0233
See application file for complete search history.

(56) References Cited

U.S. PATENT DOCUMENTS

2020/0302876 A1* 9/2020 Shin ..... G09G 3/3266

FOREIGN PATENT DOCUMENTS

KR 20140136271 A * 11/2014 ..... H01L 27/3258

* cited by examiner

*Primary Examiner* — Michael Pervan
(74) *Attorney, Agent, or Firm* — Ling Wu; Stephen Yang; Ling and Yang Intellectual Property

(57) ABSTRACT

A pixel circuit includes an input module, an emission control module, a compensation module, a driving transistor and a light emitting device. The input module is configured to provide a signal of a data signal terminal to a gate of the driving transistor and provide a signal of an initialization signal terminal to a second electrode of the driving transistor. The compensation module is configured to provide a signal of a power supply voltage terminal to a first electrode of the driving transistor. The emission control module is configured to provide a signal of a reference voltage signal terminal to the gate of the driving transistor and conduct the second electrode of the driving transistor with the light emitting device.

20 Claims, 4 Drawing Sheets

PIXEL CIRCUIT, DRIVING METHOD AND DISPLAY APPARATUS

CROSS-REFERENCE TO RELATED APPLICATION

The present application claims the priority of Chinese invention patent application with an application number of 201911147729.0, filed on Nov. 21, 2019, the content of which is incorporated by reference herein.

TECHNICAL FIELD

Embodiments of the present disclosure relate to a pixel circuit, a driving method and a display apparatus.

BACKGROUND

An Organic Light Emitting Diode (OLED) panel has attracted wide attentions for its characteristics, such as flexibility, high contrast and low power consumption. A pixel circuit is a component of the OLED panel. Generally, OLEDs in the OLED panel are driven to emit light by a current generated by driving transistors in the pixel circuit. However, due to restriction of process and increase in use time, threshold voltages (Vth) of driving transistors will drift to different extents, causing a problem of nonuniform luminous brightness of the OLEDs on the OLED panel. Furthermore, existence of IR Drop in the OLED panel will also cause the problem of nonuniform luminous brightness of the OLEDs on the OLED panel.

SUMMARY

Embodiments of the present disclosure provide a pixel circuit, a driving method and a display apparatus, to solve the above problems.

According to at least one embodiment of the present disclosure, there is provided a pixel circuit including an input module, an emission control module, a compensation module, a driving transistor and a light emitting device. The input module is configured to provide a signal of a data signal terminal to a gate of the driving transistor and provide a signal of an initialization signal terminal to a second electrode of the driving transistor. The compensation module is configured to provide a signal of a power supply voltage terminal to a first electrode of the driving transistor. The emission control module is configured to provide a signal of a reference voltage signal terminal to the gate of the driving transistor and conduct the second electrode of the driving transistor with the light emitting device.

According to the pixel circuit of any one of the foregoing embodiments provided by embodiments of the present disclosure, for example, the pixel circuit further includes a first storage module, which is configured to store the signal of the reference voltage signal terminal and a signal of the gate of the driving transistor.

According to the pixel circuit of any one of the foregoing embodiments provided by embodiments of the present disclosure, for example, the pixel circuit further includes a second storage module, which is configured to store the signal of the reference voltage signal terminal and a signal of the second electrode of the driving transistor.

According to the pixel circuit of any one of the foregoing embodiments provided by embodiments of the present disclosure, for example, the first storage module includes a first capacitor, a first end of the first capacitor is electrically connected with the gate of the driving transistor, and a second end of the first capacitor is electrically connected with the reference voltage signal terminal.

According to the pixel circuit of any one of the foregoing embodiments provided by embodiments of the present disclosure, for example, the second storage module includes a second capacitor, a first end of the second capacitor is electrically connected with the reference voltage signal terminal, and a second end of the second capacitor is electrically connected with the second electrode of the driving transistor.

According to the pixel circuit of any one of the foregoing embodiments provided by embodiments of the present disclosure, for example, the input module is further configured to provide the signal of the data signal terminal to the gate of the driving transistor under control of a first scan signal terminal.

According to the pixel circuit of any one of the foregoing embodiments provided by embodiments of the present disclosure, for example, the input module includes a first switch transistor, a first end of the first switch transistor is electrically connected with the data signal terminal, a control end of the first switch transistor is electrically connected with the first scan signal terminal, and a second end of the first switch transistor is electrically connected with the gate of the driving transistor.

According to the pixel circuit of any one of the foregoing embodiments provided by embodiments of the present disclosure, for example, the input module is further configured to provide the signal of the initialization signal terminal to the second electrode of the driving transistor under control of the first scan signal terminal.

According to the pixel circuit of any one of the foregoing embodiments provided by embodiments of the present disclosure, for example, the input module further includes a second switch transistor, a first end of the second switch transistor is electrically connected with the initialization signal terminal, a control end of the second switch transistor is electrically connected with the first scan signal terminal, and a second end of the second switch transistor is electrically connected with the second electrode of the driving transistor.

According to the pixel circuit of any one of the foregoing embodiments provided by embodiments of the present disclosure, for example, the emission control module is further configured to provide the signal of the reference voltage signal terminal to the gate of the driving transistor under control of an emission control signal terminal.

According to the pixel circuit of any one of the foregoing embodiments provided by embodiments of the present disclosure, for example, the emission control module includes a third switch transistor, and the emission control signal terminal includes a first emission control signal terminal, a first end of the third switch transistor is electrically connected with the reference voltage signal terminal, a control end of the third switch transistor is electrically connected with the first emission control signal terminal, and a second end of the third switch transistor is electrically connected with the gate of the driving transistor.

According to the pixel circuit of any one of the foregoing embodiments provided by embodiments of the present disclosure, for example, the emission control module is further configured to conduct the second electrode of the driving transistor with the light emitting device under control of an emission control signal terminal.

According to the pixel circuit of any one of the foregoing embodiments provided by embodiments of the present disclosure, for example, the emission control module further includes a fourth switch transistor, and the emission control signal terminal further includes a second emission control signal terminal, a first end of the fourth switch transistor is electrically connected with the second electrode of the driving transistor, a control end of the fourth switch transistor is electrically connected with the second emission control signal terminal, and a second end of the fourth switch transistor is electrically connected with the light emitting device.

According to the pixel circuit of any one of the foregoing embodiments provided by embodiments of the present disclosure, for example, a first end of the light emitting device is electrically connected with the second end of the fourth switch transistor, and a second end of the light emitting device is electrically connected with a reference power supply terminal.

According to the pixel circuit of any one of the foregoing embodiments provided by embodiments of the present disclosure, for example, the compensation module is further configured to provide the signal of the power supply voltage terminal to the first electrode of the driving transistor under control of a second scan signal terminal.

According to the pixel circuit of any one of the foregoing embodiments provided by embodiments of the present disclosure, for example, the compensation module includes a fifth switch transistor, a first end of the fifth switch transistor is electrically connected with the power supply voltage terminal, a control end of the fifth switch transistor is electrically connected with the second scan signal terminal, and a second end of the fifth switch transistor is electrically connected with the first electrode of the driving transistor.

According to the pixel circuit of any one of the foregoing embodiments provided by embodiments of the present disclosure, for example, a voltage of the signal of the reference voltage signal terminal is greater than a voltage of the signal of the data signal terminal.

According to the pixel circuit of any one of the foregoing embodiments provided by embodiments of the present disclosure, for example, a difference between a voltage of the signal of the data signal terminal and a voltage of the signal of the initialization signal terminal is larger than a threshold voltage of the driving transistor.

According to at least one embodiment provided by the present disclosure, there is also provided a display apparatus including the pixel circuit described in any one of the foregoing embodiments.

According to at least one embodiment provided by the present disclosure, there is also provided a driving method of the pixel circuit as in any one of the foregoing embodiments. The driving method includes: during data inputting, loading a signal with a first level to a first scan signal terminal, loading a signal with a second level to a second scan signal terminal, and loading the signal with the second level to an emission control signal terminal; during voltage compensation, loading the signal with the second level to the first scan signal terminal, loading the signal with the first level to the second scan signal terminal, and loading the signal with the second level to the emission control signal terminal; and during light emission driving, loading the signal with the second level to the first scan signal terminal, loading the signal with the first level to the second scan signal terminal, and loading the signal with the first level to the emission control signal terminal.

DETAILED DESCRIPTION

Figure 1:
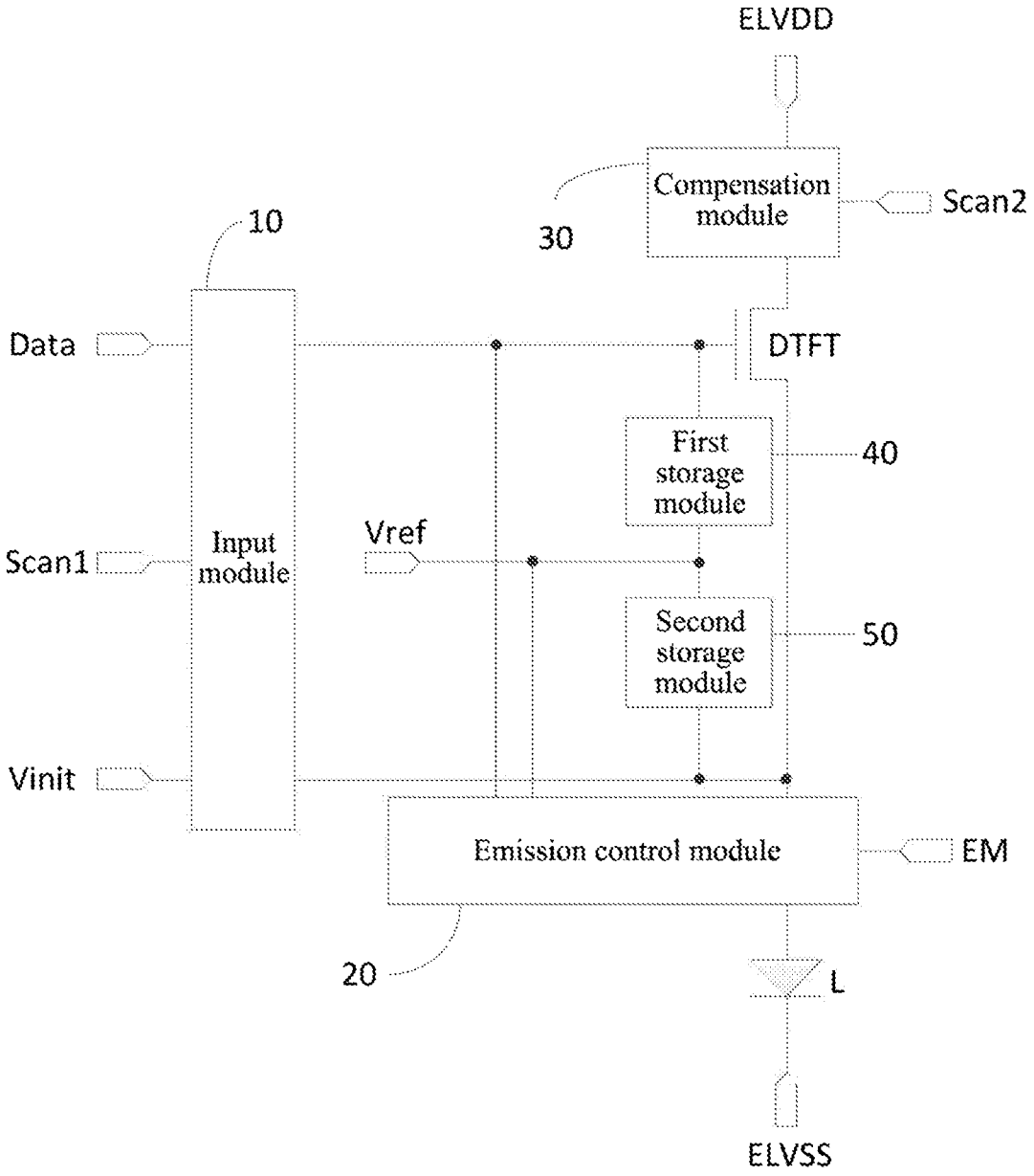
FIG. 1 is a schematic structural diagram of a pixel circuit provided by an embodiment of the present disclosure.

In order to make objectives, technical solutions and advantages of the embodiments of the present disclosure more clear, the technical solutions of the embodiments of the present disclosure will be clearly and completely described below with reference to the drawings of the embodiments of the present disclosure. The described embodiments are apparently part of the embodiments of the present disclosure, rather than all of the embodiments. Furthermore, without a conflict, embodiments in the present disclosure and features in the embodiments may be combined with each other. Based on the described embodiments of the present disclosure, all other embodiments obtained by those of ordinary skills in the art without creative work are covered by the scope of protection of the present disclosure.

Unless otherwise defined, technical terms or scientific terms used in the present disclosure shall have the ordinary meaning understood by those with ordinary skills in the art to which the present disclosure pertains. The wordings "first", "second" and the like used in the present disclosure do not represent any order, quantity or importance, but are merely used to distinguish among different components. Words such as "comprising", "including", or the like, mean that the elements or articles preceding the word cover elements or articles listed after the word and their equivalents, and do not exclude other elements or articles. Terms such as "connect", "link", or the like, are not limited to physical or mechanical connections, but may include electrical connections, whether direct or indirect.

It should be noted that sizes and shapes of various figures in the drawings do not reflect real proportions, and are only for the purpose of schematically illustrating contents of the present disclosure. Moreover, the same or similar elements and the elements having same or similar functions are denoted by same or similar reference numerals throughout the descriptions.

A pixel circuit provided by an embodiment of the present disclosure is shown in FIG. 1. The pixel circuit includes an input module 10, an emission control module 20, a compensation module 30, a driving transistor (DTFT) and a light emitting device (L).

The input module 10 is configured to provide a signal of a data signal terminal (Data) to a gate of the driving transistor (DTFT) and a signal of an initialization signal terminal (Vinit) to a second electrode of the driving transistor (DTFT). For example, under control of a signal of a first scan signal terminal (Scan1), the input module may provide the signal of the data signal terminal (Data) to the gate of the driving transistor (DTFT) and the signal of the initialization signal terminal (Vinit) to the second electrode of the driving transistor (DTFT).

The emission control module 20 is configured to provide a signal of a reference voltage signal terminal (Vref) to the gate of the driving transistor (DTFT) and conduct the second electrode of the driving transistor (DTFT) with a first end of the light emitting device (L). For example, under control of a signal of an emission control signal terminal (EM), the emission control module 20 may provide the signal of the reference voltage signal terminal (Vref) to the gate of the driving transistor (DTFT) and conduct the second electrode of the driving transistor (DTFT) with the first end of the light emitting device (L).

For example, in an embodiment of the present disclosure, the emission control signal terminal may include a first emission control signal terminal connected with a control end of a third switch transistor (T3) and a second emission control signal terminal connected with a control end of a forth switch transistor (T4). The first emission control signal terminal and the second emission control signal terminal are respectively configured to control the third switch transistor (T3) and the forth switch transistor (T4).

The compensation module 30 is configured to provide a signal of a power supply voltage terminal (ELVDD) to a first electrode of the driving transistor (DTFT). For example, the compensation module 30 may provide the signal of the power supply voltage terminal (ELVDD) to the first electrode of the driving transistor (DTFT) under control of a signal of a second scan signal terminal (Scan2).

According to the pixel circuit provided by the embodiment of the present disclosure, a threshold voltage (Vth) of the driving transistor (DTFT) can be compensated by the above modules and elements working together, and a voltage of the power supply voltage terminal (ELVDD) can further be compensated, thereby avoiding a problem of nonuniform luminous brightness of an OLED display panel.

As shown in FIG. 1, the pixel circuit may further include a first storage module 40 and a second storage module 50.

The first storage module 40 is configured to store signals of the reference voltage signal terminal (Vref) and the gate of the driving transistor (DTFT).

The second storage module 50 is configured to store signals of the reference voltage signal terminal (Vref) and the second electrode of the driving transistor (DTFT).

According to the pixel circuit provided by the embodiment of the present disclosure, a threshold voltage (Vth) of the driving transistor (DTFT) can be compensated by the above modules and elements working together, so that a driving current for driving the light emitting device (L) to emit light is not affected by the threshold voltage (Vth) of the driving transistor (DTFT), and a problem of nonuniform luminous brightness caused by the nonuniform threshold voltage (Vth) is alleviated. Furthermore, a voltage of the power supply voltage terminal (ELVDD) can further be compensated by the above modules and elements working together, so that a driving current is not affected by the voltage of the power supply voltage terminal (ELVDD), and a problem of nonuniform luminous brightness caused by IR Drop of the power supply voltage terminal (ELVDD) can be alleviated.

Figure 2:
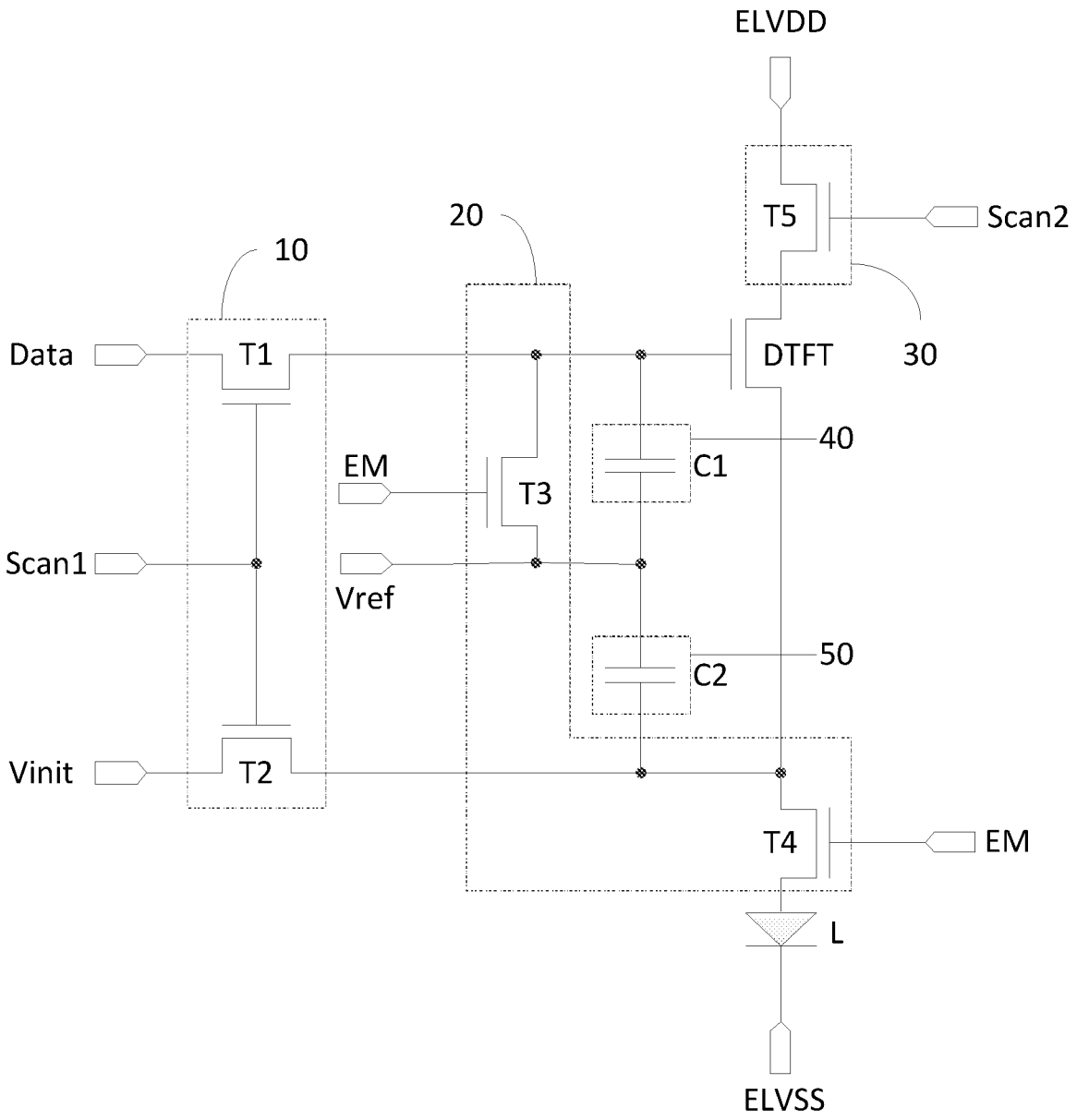
FIG. 2 is a schematic structural diagram of a pixel circuit provided by an embodiment of the present disclosure.

In an example, in a pixel circuit provided by an embodiment of the present disclosure, as shown in FIG. 1 and FIG. 2, the driving transistor (DTFT) may be an N-type transistor. For a case in which the driving transistor (DTFT) is a P-type transistor, a design principle is the same as that of the present disclosure, and it also falls into the protection scope of the present disclosure.

In an example, in a pixel circuit provided by an embodiment of the present disclosure, a first end of the light emitting device (L) is electrically connected with the emission control module 20, and a second end of the light emitting device (L) is electrically connected with the reference power supply terminal (ELVSS). Furthermore, in an example, the light emitting device (L) may be at least one of an organic light emitting diode and a Quantum Dot Light Emitting Diode (QLED). For example, when the light emitting device (L) is an OLED, a positive electrode of the OLED is the first end of the light emitting device (L), and a negative electrode is the second end of the light emitting device (L).

In an example, in a pixel circuit provided by an embodiment of the present disclosure, as shown in FIG. 2, the first storage module 40 may include a first capacitor (C1). For example, a first end of the first capacitor (C1) is electrically connected with the gate of the driving transistor (DTFT), and a second end of the first capacitor (C1) is electrically connected with the reference voltage signal terminal (Vref).

In an example, the first capacitor (C1) keeps charge conservation and may store a voltage input to the first end of the first capacitor (C1). When the gate of the driving transistor (DTFT) is in a floating state, the first capacitor (C1) may keep a voltage difference between the gate of the driving transistor (DTFT) and the voltage of the first end of the first capacitor (C1) unchanged. In an example, the first end of the first capacitor (C1) is connected with the gate of the DTFT, and the second end of the first capacitor (C1) is connected with the reference voltage signal terminal. Furthermore, in an example, the first capacitor (C1) is further electrically connected with a second end (e.g., source or drain) of the third switch transistor (T3), and the second end of the first capacitor (C1) is further electrically connected with a first end (e.g., drain or source different from the first end) of the third switch transistor (T3).

In an example, in a pixel circuit provided by an embodiment of the present disclosure, as shown in FIG. 2, the second storage module 50 may include a second capacitor (C2), a first end of the second capacitor (C2) is electrically connected with the reference voltage signal terminal (Vref), and a second end of the second capacitor (C2) is electrically connected with the second electrode of the driving transistor (DTFT). Furthermore, in an example, the first end of the second capacitor (C2) is further connected with the first end (e.g., source or drain) of the third switch transistor (T3), and the second end of the second capacitor (C2) is further connected with a second end (e.g., source or drain) of a second switch transistor (T2).

In an example, the second capacitor (C2) keeps charge conservation and may store a voltage input to the second end of the second capacitor (C2). When the second electrode of the driving transistor (DTFT) is in a floating state, the second capacitor (C2) may keep a voltage difference between the second electrode of the driving transistor (DTFT) and the voltage of the second end of the second capacitor (C2) unchanged.

By arrangement of the above-mentioned first capacitor (C1) and second capacitor (C2), for example, charging and discharging the capacitors through voltage differences, voltages at different nodes in the pixel circuit can be adjusted and controlled, thereby controlling functions of the circuit.

In an example, in a pixel circuit provided by an embodiment of the present disclosure, as shown in FIG. 2, the input module 10 may include a first switch transistor (T1) and a second switch transistor (T2). A first end of the first switch transistor (T1) is electrically connected with the data signal terminal (Data), a control end of the first switch transistor (T1) is electrically connected with the first scan signal terminal (Scan1), and a second end of the first switch transistor (T1) is electrically connected with the gate of the driving transistor (DTFT).

A first end of the second switch transistor (T2) is electrically connected with the initialization signal terminal (Vinit), a control end of the second switch transistor (T2) is electrically connected with the first scan signal terminal (Scan1), and a second end of the second switch transistor (T2) is electrically connected with the second electrode of the driving transistor (DTFT).

In an example, when the first switch transistor (T1) is in a turned-on state under control of the signal of the first scan signal terminal (Scan1), the signal of the data signal terminal (Data) may be provided to the gate of the driving transistor (DTFT). When the second switch transistor (T2) is in a turned-on state under control of the signal of the first scan signal terminal (Scan1), the signal of the initialization signal terminal (Vinit) may be provided to the second electrode of the driving transistor (DTFT).

By controlling turned-on or turned-off of the first switch transistor and the second switch transistor, the pixel circuit of the embodiment of the present disclosure can achieve input of data signals or input of voltage signals, thereby achieving control of the pixel circuit.

In an example, in a pixel circuit provided by an embodiment of the present disclosure, as shown in FIG. 2, the emission control module 20 may include a third switch transistor (T3) and a fourth switch transistor (T4).

A first end of the third switch transistor (T3) is electrically connected with the reference voltage signal terminal (Vref), a control end of the third switch transistor (T3) is electrically connected with a first emission control signal terminal, and a second end of the third switch transistor (T3) is electrically connected with the gate of the driving transistor (DTFT).

A first end of the fourth switch transistor (T4) is electrically connected with the second electrode of the driving transistor (DTFT), a control end of the fourth switch transistor (T4) is electrically connected with a second emission control signal terminal, and a second end of the fourth switch transistor (T4) is electrically connected with the first end of the light emitting device (L). In an example, when the third switch transistor (T3) is in a turned-on state under control of a signal of the emission control signal terminal (EM), the signal of the reference voltage signal terminal (Vref) may be provided to the gate of the driving transistor (DTFT). When the fourth switch transistor (T4) is in a turned-on state under control of the signal of the emission control signal terminal (EM), the second electrode of the driving transistor (DTFT) may be conducted with the first end of the light emitting device (L) to drive the light emitting device (L) to emit light. By controlling the third switch transistor and the fourth switch transistor, the pixel circuit of the embodiment of the present disclosure can achieve control of the light emitting device (L).

In an example, in a pixel circuit provided by an embodiment of the present disclosure, as shown in FIG. 2, the compensation module 30 may include a fifth switch transistor (T5), a first end of the fifth switch transistor (T5) is electrically connected with the power supply voltage terminal (ELVDD), a control end of the fifth switch transistor (T5) is electrically connected with a second scan signal terminal (Scan2), and a second end of the fifth switch transistor (T5) is electrically connected with the first electrode of the driving transistor (DTFT).

In an example, when the fifth switch transistor (T5) is in a turned-on state under control of a signal of the second scan signal terminal (Scan2), the signal of the power supply voltage terminal (ELVDD) may be provided to the first electrode of the driving transistor (DTFT). By turned-on of the fifth switch transistor (T5), a current at the power supply voltage terminal can flow, so that potentials of nodes in the circuit can be adjusted and at least one of the first capacitor or the second capacitor can be charged.

In an example, in the above pixel circuit provided by the embodiment of the present disclosure, a voltage Vr of a signal of the reference voltage signal terminal (Vref) may be larger than a voltage Vdata of the signal of the data signal terminal (Data), that is, Vr>Vdata. The above voltage values may be preset before the circuit is turned on.

In an example, in the above pixel circuit provided by the embodiment of the present disclosure, a difference between the voltage Vdata of the signal of the data signal terminal (Data) and the voltage Vi of the signal of the initialization signal terminal (Vinit) is larger than a threshold voltage (Vth) of the driving transistor (DTFT). That is, Vdata-Vi>Vth. For example, the voltage Vdata of the signal of the data signal terminal (Data) and the voltage Vi of the signal of the initialization signal terminal (Vinit) may be set according to threshold voltages of different driving transistors (DTFTs), so as to make the above conditions be satisfied.

Furthermore, the voltage of the power supply voltage terminal (ELVDD), the voltage Vr of the signal of the reference voltage signal terminal (Vref) and the voltage Vdata of the signal of the data signal terminal (Data) may be positive voltages, while the voltage of the reference power supply terminal (ELVSS) and the voltage Vi of the signal of the initialization signal terminal (Vinit) may be negative voltages. Of course, specific voltage values of the above voltages may be designed and determined according to an actual application environment, and are not limited here.

The above are only examples to illustrate structures of various modules in the pixel circuit provided by the embodiment of the present disclosure. In an example, the specific structures of various modules are not limited to the above structures provided by the embodiment of the present disclosure, but may be other structures known to those skilled in the art, and are not limited here.

In an example, in order to unify a manufacturing process, as shown in FIG. 2, in a pixel circuit provided by an embodiment of the present disclosure, all transistors may be N-type transistors. Of course, all transistors may be P-type transistors, which is not limited here.

In an example, in a pixel circuit provided by an embodiment of the disclosure, the P-type transistor is turned on under action of a low-level signal and turned off under action of a high-level signal; the N-type transistor is turned on under action of a high-level signal and turned off under action of a low-level signal.

In an example, in a pixel circuit provided by an embodiment of the present disclosure, the above transistors may be Thin Film Transistors (TFTs) or Metal-Oxide-Semiconductor Field-Effect Transistors (MOS). And the above transistors are not limited here. Furthermore, according to the different types of the above-mentioned transistors and the different signals of the gates of the above-mentioned transistors, the first electrodes of the above-mentioned transistors may be used as sources and the second electrodes as drains, or the first electrodes of the above transistors may be used as drains and the second electrodes as sources, which is not specifically distinguished here.

A working process of the pixel circuit provided by an embodiment of the present disclosure will be described below with reference to a circuit timing diagram. In the following description, 1 represents a high potential and 0 represents a low potential. It should be noted that 1 and 0 are logic potentials, which are only for better explaining the specific working process of an embodiment of the present disclosure, but not specific voltage values.

Figure 3:
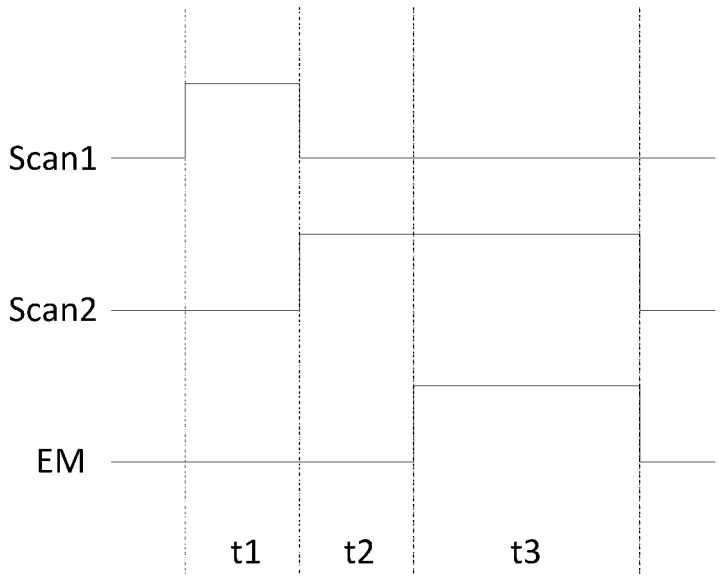
FIG. 3 is a circuit signal timing diagram of the pixel circuit shown in FIG. 2.

Taking the pixel circuit shown in FIG. 2 as an example, the working process of the above pixel circuit provided by the embodiment of the present disclosure will be described with reference to a circuit signal timing diagram in FIG. 3. In an example, three stages, i.e., t1, t2 and t3 stages, in the circuit signal timing diagram shown in FIG. 3 are selected.

At t1 stage, for example, Scan1=1, Scan2=0, and EM=0.

Since Scan1=1, the first switch transistor (T1) and the second switch transistor (T2) are turned on. Since Scan2=0, the fifth switch transistor (T5) is turned off. Since EM=0, the third switch transistor (T3) and the fourth switch transistor (T4) are turned off.

The first switch transistor (T1) is turned on, and a signal of the data signal terminal (Data) is provided to the gate of the driving transistor (DTFT) and stored at the first end of the first capacitor (C1). At this time, a potential of the first end of first capacitor (C1) may be Vdata. The second switch transistor (T2) is turned on, and a signal of the initialization signal terminal (Vinit) is provided to the second electrode of the driving transistor (DTFT) and stored at the second end of the second capacitor (C2). At this time, a potential of the second end of the second capacitor (C2) may be Vinit, which is equal to the potential of the initialization signal terminal (Vinit) and may be abbreviated as Vi in the present disclosure.

At t2 stage, for example, Scan1=0, Scan2=1, and EM=0.

Because Scan1=0, the first switch transistor (T1) and the second switch transistor (T2) are turned off. Because Scan2=1, the fifth switch transistor (T5) is turned on. Since EM=0, the third switch transistor (T3) and the fourth switch transistor (T4) are turned off.

The fifth switch transistor (T5) is turned on to provide a signal of the power supply voltage terminal (ELVDD) to the first electrode of the driving transistor (DTFT), for example, the drain of the (DTFT). The first capacitor (C1) still stores the voltage Vdata of the signal of the data signal terminal (Data) input at the t1 stage. With reference to the previous description, in the pixel circuit according to the embodiment of the present disclosure, it has been preset that the difference between the voltage Vdata of the signal of the data signal terminal (Data) and the voltage Vi of the signal of the initialization signal terminal (Vinit) is larger than the threshold voltage (Vth) of the driving transistor (DTFT). That is, Vdata-Vi>Vth. In other words, Vdata>Vi+Vth, at this time, a voltage difference between the gate and the second electrode of the driving transistor (DTFT) is Vgs=Vdata-Vi>Vth, so that the driving transistor (DTFT) is turned on. As the fifth switch transistor (T5) is turned on, the (DTFT) is also turned on, while the fourth switch transistor (T4) is turned off, referring to the circuit diagram of FIG. 2, at this time, a current flowing from the power supply voltage terminal (ELVDD) may continue to charge the second end of the C2 through the (T5) and (DTFT). When the charged amount of the second end of the C2 reaches Vdata-Vth, that is, the voltage of the second electrode of the driving transistor (DTFT) is Vdata-Vth, because a potential of the first end of the first capacitor always stores the potential Vdata, that is, a potential of the gate of the driving transistor (DTFT) is Vdata, a voltage difference between the gate and the second electrode of the driving transistor (DTFT) is Vdata-(Vdata-Vth), equal to Vth, then the driving transistor (DTFT) is turned off. Furthermore, the voltage of the second electrode of the driving transistor (DTFT) is stored at the second end of the second capacitor (C2).

At t3 stage, Scan1=0, Scan2=1 and EM=1.

Because Scan1=0, the first switch transistor (T1) and the second switch transistor (T2) are turned off. Because Scan2=1, the fifth switch transistor (T5) is turned on. Since EM=1, that is, the signals of the first emission control signal terminal and the second emission control signal terminal are both 1, the third switch transistor (T3) and the fourth switch transistor (T4) are turned on.

The third switch transistor (T3) is turned on to provide the signal of the reference voltage signal terminal (Vref) to the gate of the driving transistor, that is, a potential of the gate of the driving transistor (DTFT) is (Vref) at this time, which may be abbreviated as Vr in the present disclosure. The second end of the second capacitor (C2) still stores the voltage Vdata-Vth of the signal at the t2 stage, that is, the potential of the second electrode of the driving transistor (DTFT) is Vdata-Vth. Accordingly, a voltage difference between the gate and the second electrode of the driving transistor (DTFT) is Vgs=Vr−(Vdata−Vth)=Vr−Vdata+Vth, and since Vr>Vdata, the driving transistor (DTFT) is turned on. The fourth switch transistor (T4) is turned on, the second electrode of the driving transistor (DTFT) is conducted with the first end of the light emitting device (L), and the driving transistor (DTFT) outputs a driving current I to make the light emitting device (L) emit light.

A formula of the driving current I is: $I=K(Vgs-Vth)^2=K(Vr-Vdata)^2$, where $$K=\frac{1}{2}\mu_n C_{ox}\frac{W}{L},$$

$\mu_n$ represents a mobility of the driving transistor (DTFT), $C_{ox}$ represents a gate oxide capacitance per unit area, and $$\frac{W}{L}$$

represents a width-length ratio of the driving transistor (DTFT), and these values are relatively stable in the same structure and may be considered as constants.

It can be seen from the above formula that in this case, the driving current I output by the driving transistor (DTFT) is not affected by the threshold voltage (Vth) of the driving transistor (DTFT) and an IR Drop of the power supply voltage source (ELVDD), but is only related to the voltage Vdata of the signal of the data signal terminal (Data) and the voltage Vr of the signal of the reference voltage signal terminal (Vref), therefore problems of drift of the threshold voltage of the driving transistor (DTFT) and the IR Drop of the power supply voltage source (ELVDD), caused by the process and long-time operation, are alleviated, thereby the display effect is enhanced.

Figure 4:
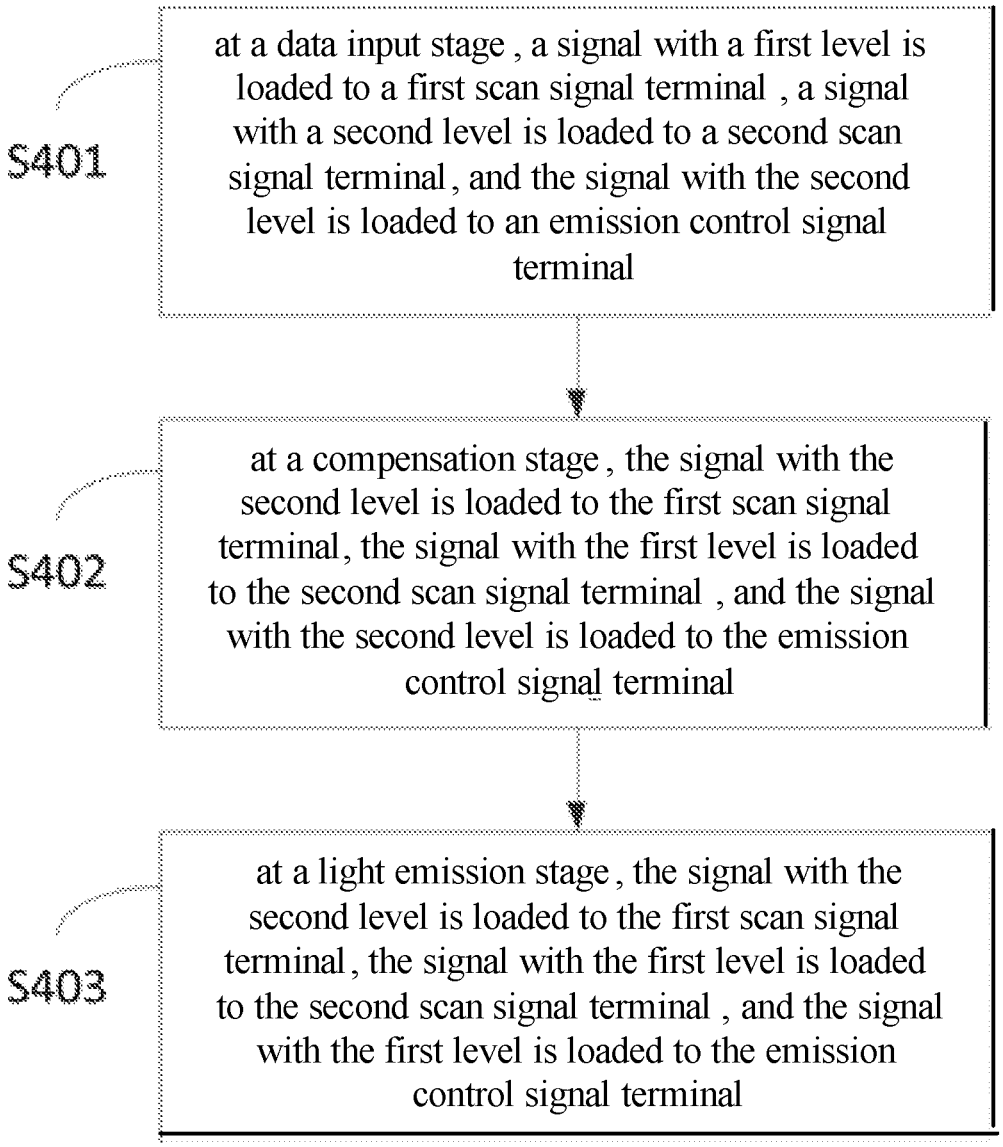
FIG. 4 is a flowchart of a driving method provided by an embodiment of the present disclosure.

Based on the same inventive concept, an embodiment of the present disclosure further provides a driving method of the above pixel circuit provided by the embodiment of the present disclosure, which may be performed on the basis of any of the aforementioned examples or embodiments. As shown in FIG. 4, the driving method of the pixel circuit includes the following acts S401-S403.

In S401, at a data input stage, a signal with a first level is loaded to a first scan signal terminal, a signal with a second level is loaded to a second scan signal terminal, and the signal with the second level is loaded to an emission control signal terminal.

In S402, at a compensation stage, the signal with the second level is loaded to the first scan signal terminal, the signal with the first level is loaded to the second scan signal terminal, and the signal with the second level is loaded to the emission control signal terminal.

In S403, at a light emission stage, the signal with the second level is loaded to the first scan signal terminal, the signal with the first level is loaded to the second scan signal terminal, and the signal with the first level is loaded to the emission control signal terminal.

In an example, the first level may be a high level, and the second level may be a low level. Or, the first level is a low level, and the second level is a high level.

Based on the same inventive concept, an embodiment of the present disclosure further provides a display apparatus, which includes any of the above pixel circuits. Implementation of the display apparatus may refer to any of the above embodiments and examples of the pixel circuit, and the repetition is not repeated here.

In an example, the display apparatus may be any product or component with a display function such as a mobile phone, a tablet computer, a television, a display, a notebook computer, a digital photo frame, a navigator, etc. Those of ordinary skill in the art should understand that the display apparatus has other essential components, which will not be described in detail here, and should not be taken as a limitation of the present disclosure.

According to the pixel circuit, the driving method of the pixel circuit and the display apparatus provided by embodiments of the present disclosure, the pixel circuit includes an input module, an emission control module, a compensation module, a first storage module, a second storage module, a driving transistor and a light emitting device. Under control of a signal of a first scan signal terminal, the input module may provide a signal of a data signal terminal to a gate of the driving transistor and a signal of an initialization signal terminal to a second electrode of the driving transistor. Under control of a signal of an emission control signal terminal, the emission control module may provide a signal of a reference voltage signal terminal to the gate of the driving transistor and conduct the second electrode of the driving transistor with a first end of the light emitting device. The compensation module may provide a signal of a power supply voltage terminal to a first electrode of the driving transistor under control of a signal of a second scan signal terminal. The first storage module may store signals of the reference voltage signal terminal and the gate of the driving transistor; and the second storage module may store signals of the reference voltage signal terminal and the second electrode of the driving transistor. A threshold voltage of the driving transistor can be compensated by the above modules and elements working together, so that a driving current for driving the light emitting device to emit light is not affected by the threshold voltage of the driving transistor, and a problem of nonuniform luminous brightness caused by the nonuniform threshold voltage is alleviated. Furthermore, a voltage of the power supply voltage terminal can be compensated by the above modules and elements working together, so that a driving current is not affected by the voltage of the power supply voltage terminal, and a problem of nonuniform luminous brightness caused by IR Drop of the power supply voltage terminal can be alleviated.

Apparently, various modifications and variations to the present disclosure may be made by those skilled in the art without departing from the spirit and scope of the present disclosure. Thus, if these modifications and variations to the present disclosure fall within the scope of the claims of the present disclosure and their equivalent techniques, the present disclosure is intended to include these modifications and variations.

What we claim is:

1. A pixel circuit, comprising:

an input module, an emission control module, a compensation module, a driving transistor and a light emitting device; wherein, the input module is configured to provide a signal of a data signal terminal to a gate of the driving transistor, and provide a signal of an initialization signal terminal to a second electrode of the driving transistor;

the compensation module is configured to provide a signal of a power supply voltage terminal to a first electrode of the driving transistor; and the emission control module is configured to provide a signal of a reference voltage signal terminal to the gate of the driving transistor and conduct the second electrode of the driving transistor with the light emitting device.

2. The pixel circuit according to claim 1, further comprising a first storage module, wherein the first storage module is configured to store the signal of the reference voltage signal terminal and a signal of the gate of the driving transistor.

3. The pixel circuit according to claim 2, further comprising a second storage module, wherein the second storage module is configured to store the signal of the reference voltage signal terminal and a signal of the second electrode of the driving transistor.

4. The pixel circuit according to claim 3, wherein the second storage module comprises a second capacitor, a first end of the second capacitor is electrically connected with the reference voltage signal terminal, and a second end of the second capacitor is electrically connected with the second electrode of the driving transistor.

5. The pixel circuit according to claim 3, wherein the input module is further configured to provide the signal of the data signal terminal to the gate of the driving transistor under control of a first scan signal terminal.

6. The pixel circuit according to claim 5, wherein the input module comprises a first switch transistor, wherein a first end of the first switch transistor is electrically connected with the data signal terminal, a control end of the first switch transistor is electrically connected with the first scan signal terminal, and a second end of the first switch transistor is electrically connected with the gate of the driving transistor.

7. The pixel circuit according to claim 5, wherein the input module is further configured to provide the signal of the initialization signal terminal to the second electrode of the driving transistor under control of the first scan signal terminal.

8. The pixel circuit according to claim 7, wherein the input module further comprises a second switch transistor;

a first end of the second switch transistor is electrically connected with the initialization signal terminal, a control end of the second switch transistor is electrically connected with the first scan signal terminal, and a second end of the second switch transistor is electrically connected with the second electrode of the driving transistor.

9. The pixel circuit according to claim 7, wherein the emission control module is further configured to provide the signal of the reference voltage signal terminal to the gate of the driving transistor under control of an emission control signal terminal.

10. The pixel circuit according to claim 9, wherein the emission control module comprises a third switch transistor, and the emission control signal terminal comprises a first emission control signal terminal, a first end of the third switch transistor is electrically connected with the reference voltage signal terminal, a control end of the third switch transistor is electrically connected with the first emission control signal terminal, and a second end of the third switch transistor is electrically connected with the gate of the driving transistor.

11. The pixel circuit according to claim 2, wherein the first storage module comprises a first capacitor, a first end of the first capacitor is electrically connected with the gate of the driving transistor, and a second end of the first capacitor is electrically connected with the reference voltage signal terminal.

12. The pixel circuit according to claim 1, wherein the emission control module is further configured to conduct the second electrode of the driving transistor with the light emitting device under control of an emission control signal terminal.

13. The pixel circuit according to claim 12, wherein the emission control module further comprises a fourth switch transistor, and the emission control signal terminal further comprises a second emission control signal terminal, a first end of the fourth switch transistor is electrically connected with the second electrode of the driving transistor, a control end of the fourth switch transistor is electrically connected with the second emission control signal terminal, and a second end of the fourth switch transistor is electrically connected with the light emitting device.

14. The pixel circuit according to claim 13, wherein a first end of the light emitting device is electrically connected with the second end of the fourth switch transistor, and a second end of the light emitting device is electrically connected with a reference power supply terminal.

15. The pixel circuit according to claim 1, wherein the compensation module is further configured to provide the signal of the power supply voltage terminal to the first electrode of the driving transistor under control of a second scan signal terminal.

16. The pixel circuit according to claim 15, wherein the compensation module comprises a fifth switch transistor, a first end of the fifth switch transistor is electrically connected with the power supply voltage terminal, a control end of the fifth switch transistor is electrically connected with the second scan signal terminal, and a second end of the fifth switch transistor is electrically connected with the first electrode of the driving transistor.

17. The pixel circuit according to claim 1, wherein a voltage of the signal of the reference voltage signal terminal is greater than a voltage of the signal of the data signal terminal.

18. The pixel circuit according to claim 1, wherein a difference between a voltage of the signal of the data signal terminal and a voltage of the signal of the initialization signal terminal is larger than a threshold voltage of the driving transistor.

19. A display apparatus, comprising the pixel circuit according to claim 1.

20. A driving method of the pixel circuit according to claim 1, comprising:

during data inputting, loading a signal with a first level to a first scan signal terminal, loading a signal with a second level to a second scan signal terminal, and loading the signal with the second level to an emission control signal terminal;

during voltage compensation, loading the signal with the second level to the first scan signal terminal, loading the signal with the first level to the second scan signal terminal, and loading the signal with the second level to the emission control signal terminal; and during light emission driving, loading the signal with the second level to the first scan signal terminal, loading the signal with the first level to the second scan signal terminal, and loading the signal with the first level to the emission control signal terminal.

* * * * *